US005340107A

United States Patent [19]

Baker et al.

[11] Patent Number: 5,340,107

[45] Date of Patent: Aug. 23, 1994

[54] MONOLITHIC CERAMIC GOLF CLUB PUTTER HEAD AND METHOD OF MANUFACTURE THEREOF

[75] Inventors: Robert R. Baker, Irvine; Robin A. Carden, Costa Mesa, both of Calif.

[73] Assignee: Ceradyne, Inc., Costa Mesa, Calif.

[21] Appl. No.: 34,476

[22] Filed: Mar. 19, 1993

[51] Int. Cl.[5] ..... A63B 53/04

[52] U.S. Cl. ..... 273/167 R; 273/DIG. 23; 273/171; 419/49

[58] Field of Search ..... 273/167 R, 77 A, 77 R, 273/162 R, DIG. 23; 501/88, 89; 419/49, 5, 40, 13; 264/56, 65

[56] References Cited

U.S. PATENT DOCUMENTS

| | | | |
|---|---|---|---|
| 1,562,956 | 11/1925 | Guerne | 273/171 X |
| 2,908,502 | 10/1959 | Bradstreet | 273/DIG. 33 |
| 3,975,023 | 8/1976 | Inamori | 273/DIG. 33 |
| 4,181,306 | 1/1980 | Jepson | 273/173 |
| 4,630,826 | 12/1986 | Nishigaki et al. | 273/167 H |
| 4,687,205 | 8/1987 | Tominaga et al. | 273/169 |
| 4,793,616 | 12/1988 | Fernandez | 273/167 H |
| 4,869,507 | 9/1989 | Sahm | 273/171 |
| 4,979,744 | 12/1990 | Alcala . | |
| 5,016,883 | 5/1991 | Kobayashi . | |
| 5,037,102 | 8/1991 | Fukayama et al. | 273/167 J |
| 5,062,638 | 11/1991 | Shira | 273/167 R |
| 5,083,778 | 1/1992 | Douglass . | |
| 5,217,227 | 6/1993 | Shira | 273/167 R |

FOREIGN PATENT DOCUMENTS

| | | | |
|---|---|---|---|
| 1190373 | 7/1989 | Japan | 273/167 R |
| 1481796 | 8/1977 | United Kingdom | 273/DIG. 33 |
| 2200558 | 10/1988 | United Kingdom | 273/77 A |

OTHER PUBLICATIONS

"Golf Digest", Magazine, Feb. 1992 issue, p. 167.

*Primary Examiner*—Jessica J. Harrison
*Assistant Examiner*—Sebastiano Passaniti
*Attorney, Agent, or Firm*—Leonard Tachner

[57] ABSTRACT

A golf club putter head made of a wear resistant and highly polished, aesthetically pleasing silicon nitride material in a manufacturing process which obviates labor intensive machining and finishing. Except for the optional addition of high density material weights at the toe and heel portions of the putter head, the present invention provides a putter head which is made of a monolithic silicon nitride ceramic which has a relatively low density of 3.3 grams per cubic centimeter and which is provided with a polished surface appearance along most of its surfaces. The present invention is preferably fabricated using a process of which the most important step is a high pressure, dry pressing step in which the unique shape of the golf club head described herein facilitates bi-axial symmetric pressure application resulting in what is known as a green part. The part may be readily completed with the steps of binder removal, nitriding and hot isostatic pressure sintering to densify and shrink the material and finishing with sandblasting and diamond lapping to provide the aesthetically pleasing highly reflective polished surface. The invention may also be fabricated using slip casting or injection molding techniques.

11 Claims, 1 Drawing Sheet

MONOLITHIC CERAMIC GOLF CLUB PUTTER HEAD AND METHOD OF MANUFACTURE THEREOF

BACKGROUND OF THE INVENTION

1. Field of the Invention

The present invention relates generally to golf club putter heads and more specifically to a monolithic ceramic golf club putter head which is cosmetically appealing and which because of its extremely low ceramic material density, permits selected weighting of the heel and toe portions thereof for improved performance. Novelty of the present invention also resides in its method of manufacture which completely obviates labor intensive machining, thereby reducing the ultimate cost of the completed part.

2. Prior Art

Two of the most important features of a golf club putter head are its appearance and its weight distribution. The cosmetic appearance of a golf club putter head is important to the user for obvious reasons. However, perhaps more importantly, the aesthetic appearance of a golf club putter head is especially significant to the manufacturer thereof, because it is perhaps its aesthetic appearance, more than any other factor which affects the consumer's level of acceptance of a golf club. The use of a highly reflective polished surface is one aspect of a conventional putter head that is considered by many to be aesthetically pleasing. Accordingly, many conventional golf club putter heads utilize a metal face that is polished or otherwise finished in a manner to provide a reflective surface. However, the cost of providing such a surface, typically makes it too expensive to give other surfaces of the golf club putter head the polished appearance of the face, thereby resulting in some reduction in the aesthetic appeal of the golf club putter head. More specifically, in most conventional golf club putter heads, the rear surface thereof, as well as the top and sole surfaces thereof may be painted with a distinct color, such as black and the like, and be provided with a non-polished finish which is less expensive to fabricate, but unfortunately detracts from the overall appearance of the golf club. Furthermore, the aesthetic appearance of conventional golf club putter heads normally deteriorates rapidly with use because metal surface putters, as well as putters made of other relatively soft materials, become rapidly worn when subjected repeatedly striking the hard surface of a conventional golf ball. Also, normal wear resulting from frictional engagement between the surface of a golf club putter and the various surfaces of a golf course green, tend to score the polished face of the putter, as well as scrape the other painted surfaces thereof.

Weight distribution in a golf club putter head has been the subject of numerous prior art golf club putter designs for many, years. Unfortunately, the high density material normally used in conventional golf club putters, limits the degree to which weight distribution can be altered without significantly affecting the aesthetic appearance of the putter and without also increasing the overall weight of the putter beyond acceptable limits. Accordingly, there would be a significant advantage in golf club putter head design if material could be found which is both aesthetically pleasing and extremely wear resistant, as well as low density, so that relatively high density materials may be added in selected positions along the golf club putter head for distributing weight in a desired fashion without affecting the appearance or total weight of the golf club putter head.

The prior art known to the applicants comprises the following U.S. Patents which disclose relevant aspects pertaining to the present invention. These include U.S. Pat. No. 4,979,744 to Alcala, U.S. Pat. No. 5,016,883 to Kobiyashi and U.S. Pat. No. 5,083,778 to Douglas. U.S. Pat. No. 4,979,744 is directed to a golf club putter having a lightweight frame made of a resin impregnated fiber material. Suitable resin impregnated fibers include graphite, boron, glass and ceramic. U.S. Pat. No. 5,016,883 is directed to a golf club head which includes a composite body including a porous ceramic body having a plurality of pores formed therein. The principal feature of this invention resides in the use of a composite body of a ceramic sponge and a metal. U.S. Pat. No. 5,083,778 to Douglas is directed to a golf club putter head which is designed to dampen or reduce the rebound of the golf ball from the striking face of the putter. The head of this putter has a laminated golf ball striking face which is secured to the under surface. The laminated striking face includes both an outer resilient layer and an inner resilient layer, the hardness of the inner layer being less than that of the outer layer. The body of the head is made preferably from a metal, a ceramic composite or a graphite composite.

SUMMARY OF THE INVENTION

The present invention comprises a golf club putter head made of a wear resistant and highly polished, aesthetically pleasing silicon nitride material in a manufacturing process which obviates labor intensive machining and finishing. Except for the optional addition of high density material weights at the toe and heel portions of the putter head, the present invention provides a putter head which is made of a monolithic silicon nitride ceramic which has a relatively low density of 3.3 grams per cubic centimeter and which is provided with a polished surface appearance on the hitting surface and other surfaces. The invention provides a very pleasing aesthetic finish which not only makes the golf club putter head of the present invention more appealing at the time of purchase, but also continues to provide an attractive new look, despite years of use because of the high resistance of the silicon nitride ceramic to ordinary wear. In addition, the present invention is preferably fabricated using a process which is relatively low cost because of a voidance of expensive, labor intensive machining and finishing that is typically incurred in the fabrication of more conventional golf club putter heads. The most important step of this process is a high pressure, dry pressing step in which the unique shape of the golf club head described herein facilitates hi-axial symmetric pressure application resulting in what is known as a green part. The shape of this green part is virtually identical to the ultimate finished part which may be readily completed with the steps of binder removal, nitriding and hot isostatic pressure sintering to densify and shrink the material and finishing with sand blasting and diamond lapping to provide the aesthetically pleasing highly reflective polished surface. The invention may also be manufactured using slip casting or injection molding, both of which also obviate or reduce manual shaping of the finished part.

OBJECTS OF THE INVENTION

It is therefore a principal object of the present invention to provide an improved golf club putter head made of a low density, wear resistant, monolithic, ceramic material which provides a highly pleasing ornamental appearance.

It is an additional object of the present invention to provide a golf club putter head made entirely of a ceramic material which provides a highly polished finished surface.

It is still an additional object of the present invention to provide a golf club putter head which is made of a ceramic material of sufficiently low density to provide toe and heel cavities for receiving a high density material for toe and heel weighting.

It is still an additional object of the present invention to provide a method for fabricating a ceramic golf club putter head wherein extensive machining and finishing are obviated.

BRIEF DESCRIPTION OF THE DRAWINGS

The aforementioned objects and advantages of the present invention, as well as additional objects and advantages thereof will be more fully understood hereinafter as a result of a detailed description of preferred embodiment in which.

DETAILED DESCRIPTION OF A PREFERRED EMBODIMENT

Figure 1:
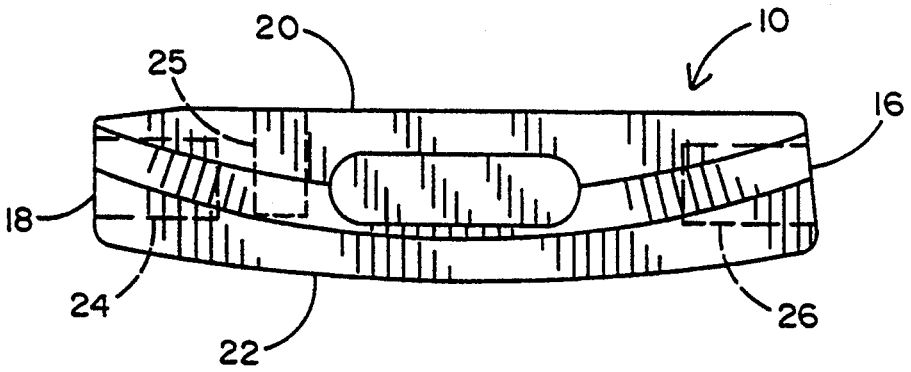
FIG. 1 is an elevational rear view of the putter head of the present invention.
Figure 2:
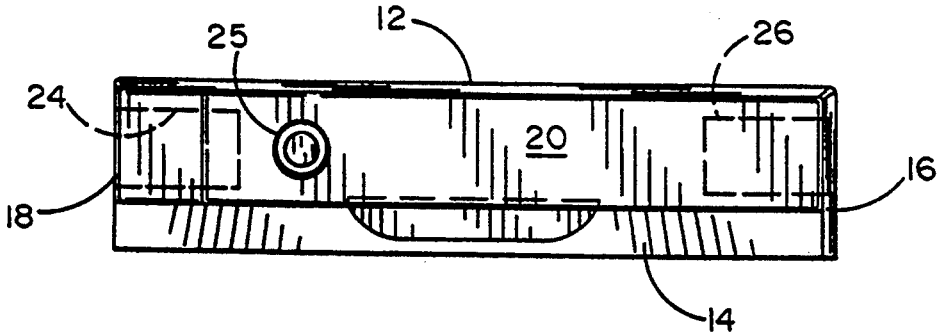
FIG. 2 is a top view of the present invention.
Figure 3:
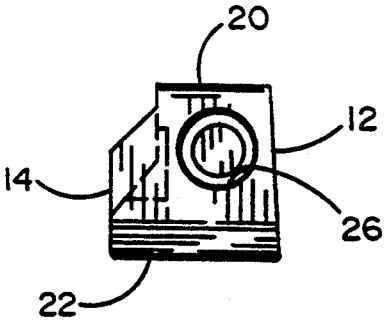
FIG. 3 is a side view of the present invention taken at the toe end of the putter head.
Figure 4:
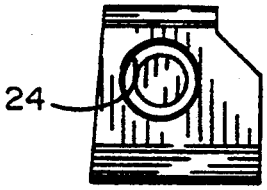
FIG. 4 is a side view of the present invention taken at the heel end of the putter head.

Referring now to the accompanying FIGS. 1 through 4, it will be seen that the golf putter head 10 of the present invention provides a front surface or ball hitting face 12, a rear surface 14, a toe surface 16, a heel surface 18, a top surface 20 and a bottom or sole surface 22. It will also be seen that the embodiment illustrated in FIGS. 1 through 4, provides three holes, namely holes 24, 25 and 26. Hole 25 is a conventional hosel hole designed to receive the shaft of the golf club putter. However, holes 24 and 26 are unconventional and are designed to permit the insertion therein of high density material for selective weight distribution of the putter head of the present invention. Such high density materials include lead or tungsten or other relatively heavy materials which may be inserted into holes 24 and 26 and epoxied therein for redistributing the weight of the putter head 10 of the present invention. The shape of the putter head 10 shown in the accompanying figures is not particularly critical and therefore it will be understood that the present invention is not to be limited to the specific putter head shape shown. However, certain aspects of the shape of the putter head shown in the accompanying figures are significant with respect to the fabrication process used to manufacture the putter head of the present invention. More specifically, in order to advantageously avoid labor intensive machining and finishing, it is highly advantageous to provide a putter head shape which is amenable to bi-axial symmetry dry pressing, as will be hereinafter more fully described.

In the process of the present invention, the first step is the preparation of a powder, the composition of which is preferrably 88.8% by weight silicon, 7.9% by weight yttrium oxide, 3.2% by weight aluminum oxide and 0.07% by weight a heavy transition metal carbide, such as tungsten carbide, titanium carbide, chrome carbide, molybdenum carbide, vanadium carbide, mobium carbide or hafnium carbide. The silicon, yttrium oxide and aluminum oxide should have a purity of at least 99.9% and the grain size of the composition powder should be approximately 5 to 7 microns. The second step in the procedure of fabrication of the present invention is to provide a homogeneous mixture of the aforementioned composition, such as by placing the composition material in a ball mill and tumbling it with a wetting agent such as water to provide a homogeneous mixture. This mixture is then spray dried in a high speed funnel-type spray dryer with heated air to remove the water.

The next step in the method of the present invention is to place the spray dried homogeneous composition into a cavity for dry-pressing at approximately 15,000 pounds per square inch. A typical cavity material is tungsten carbide. The cavity size is designed to leave approximately a 12% oversize part. As previously indicated, the relative straight surfaces of the putter head of the present invention are preferably designed to permit bi-axial symmetrical dry-pressing whereby a dry-pressing ram can be used to apply a very high pressure to the composition along one axis. After the composition is dry-pressed, the resulting green part is removed from the dye. It is at that time cavities for the shaft and optional heel and toe weight distribution materials may be made. Green machining of the part at this stage is relatively easy because it is not fully hardened and tungsten carbide bits can be used without any significant degree of difficulty.

After green machining the holes for the shaft and the toe and heel weights, the binder in the dry-pressed part is removed by heating the part to about 450 degrees Centigrade in air.

The next step in the process of the present invention is referred to as the nitriding step. This step is performed in an atmosphere of nitrogen and other mixed gases at a temperature of 1400 degrees Centigrade for a period of up to 4 or 5 days. During this step, while the volume of the material remains essentially constant, the weight is increased by approximately 55 due to the chemical transition of the silicon into silicon nitride. After completion of the nitriding step, the part is then sintered in a hot isostatic pressure vessel at a temperature of 1850 degrees Centigrade and at pressures of up to 1500 pounds per square in essentially a nitrogen environment. This step densifies the material by essentially closing all the remaining pores and shrinks the material to the desired volume. The sintering process takes approximately 18 hours with an additional 12 hours approximately required to gradually cool the material.

After removal of the part from the hot isostatic pressure vessel, the putter head of the invention is essentially complete except for steps relating to cosmetics. In this regard, the finished parts are sand blasted or placed in a vibratory mill to round the edges and remove a low density material skin. The parts are subsequently provided with a diamond lapping finish which provides a mechanical reduction of the diffusion characteristic of the surface of the material to give it its lustrous, highly reflective characteristic. At this point, the monolithic ceramic putter head of the present invention is complete except for the optional addition of high density material weights to the toe and heel holes 24 and 26 using material such as lead or tungsten and the like. The heavy material may be press fit into the hole by using a cold shrink process, such as by dipping the weights into a liquid nitrogen before inserting them into the corresponding hole. In any case, the hole is preferably then covered with an epoxy to either retain the weights within the holes or to prevent extraneous material from getting into the hole during use of the golf club putter. The putter is then connected to the shaft which may be adhesively inserted into the hosel hole 25 for completion of the finished putter.

It will now be understood that what has been described herein comprises a novel monolithic, silicon nitride putter head which provides a number of significant advantages over the prior art. Most significant is the low density silicon nitride material of which the present invention is made, thus permitting weight distribution control by providing cavities for receiving high density materials such as lead weights and the like. Another significant advantage of the present invention is its resistance to wear due to the extreme hardness of silicon nitride fabricated in accordance with the invention described herein. Still another significant advantage is the cosmetic appearance of the present invention, wherein all surfaces are of an aesthetically pleasing character and most of the surfaces are of a highly polished reflective character which provides a commercially attractive golf club putter head both before and after use. The manufacturing process of the present invention is also highly advantageous in that it overcomes or substantially reduces the prior art requirement for labor-intensive machining and finishing which significantly increase the cost of the finished product. The process of the present invention comprises steps for the manufacture of a particular silicon nitride ceramic product. The principal steps include dry-pressing the combination of silicon, yttrium oxide and aluminum oxide along with a heavy transition metal carbide. The dry-pressing step of the present invention is performed using a tungsten carbide dye and bi-axial symmetrical pressure of at least about 15,000 pounds per square inch. The part is then nitrided in a nitriding furnace over a period of several days and then sintered in a hot isostatic pressure vessel at both elevated temperature and pressure. A significant aspect of the present invention is in the shape of the putter head which permits the use of bi-axial symmetrical dry-pressing which effectively obviates the prior art machining step and thus significantly reduces the amount of manual labor required to fabricate the part. An exemplary illustration of a shape suitable for manufacture in that fashion is disclosed herewith in the accompanying figures. However, it will be understood that the invention is not to be limited to the specific illustrative embodiment disclosed therein.

Those having skill in the art to which the present invention pertains, will now as a result of the applicants' teaching herein, perceive various modifications and additions which may be made to the invention. By way of example, as previously indicated, the specific shape of the exemplary embodiment disclosed herein may be readily altered. Furthermore, specific ingredients of the ceramic composition powder that is used in the fabrication of the present invention may be altered, such as by, for example, replacing one heavy transition metal carbide with another heavy transition metal carbide. Another possible substitution of materials is to replace the silicon nitride with silicon aluminum oxynitride commonly referred to as Sialon. Accordingly, all such modifications and additions are deemed to be within the scope of the invention, which is to limited only by the claims appended hereto and their equivalents.

We claim:

1. A golf club putter head formed entirely of a monolithic, dry-pressed silicon nitride of which the hitting surface and other surfaces have a uniform polished appearance.

2. The putter head recited in claim 1 further comprising at least one cavity for receiving a high density weight-redistributing material therein.

3. The putter head recited in claim 2 said putter head having a heel and a toe and wherein there are two said cavities, one such cavity being positioned at the heel of said putter head and the other such cavity being positioned at the toe of said putter head.

4. The putter head recited in claim 2 wherein said material is taken from the group consisting of lead and tungsten.

5. A golf putter head formed entirely of monolithic, silicon nitride.

6. A golf putter head formed entirely of monolithic silicon aluminum oxynitride.

7. A method of fabricating a golf club putter head; the method comprising the following steps:

a) forming a substantially homogeneous mixture of powders having a composition by weight which is at least 85% silicon, 5% yttrium oxide, 2% aluminum oxide and less than 1% heavy transition metal carbide;

b) dry pressing said mixture using a die having the desired shape of a putter head at a pressure of about 15,000 psi;

c) sintering said dry-pressed putter head at a temperature of about 450 degrees Centigrade for about 2 hours to 4 hours;

d) nitriding said putter head in a substantially nitrogen atmosphere at a temperature of about 1400 degrees Centigrade until substantially all of the silicon has chemically combined with said nitrogen to form silicon nitride;

e) sintering said putter head in nitrogen at a temperature of about 1850 degrees Centigrade and at pressures as high as 1500 psi; and f) finishing the surface of said putter head.

8. The method recited in claim 7 wherein step f) is performed by diamond lapping.

9. A golf club putter head formed entirely of a slip cast monolithic ceramic material.

10. A golf club putter head formed entirely of an injection molded monolithic ceramic material.

11. A golf club putter head formed entirely of a nitrided silicon monolithic ceramic material.

* * * * *